US007770723B2

(12) United States Patent
Hajduk

(10) Patent No.: US 7,770,723 B2
(45) Date of Patent: Aug. 10, 2010

(54) GLOVE SHAPER KIT

(76) Inventor: Daniel John Hajduk, 4036 Columns Dr. SE., Marietta, GA (US) 30067

( * ) Notice: Subject to any disclaimer, the term of this patent is extended or adjusted under 35 U.S.C. 154(b) by 880 days.

(21) Appl. No.: 11/556,702

(22) Filed: Nov. 5, 2006

(65) Prior Publication Data

US 2008/0105571 A1 May 8, 2008

(51) Int. Cl.
*F26B 25/00* (2006.01)
*B65D 81/00* (2006.01)

(52) U.S. Cl. ..... 206/204; 206/579; 34/104; 223/78

(58) Field of Classification Search ..... 206/579, 206/204, 575, 576; 34/104, 106, 239; 223/78
See application file for complete search history.

(56) References Cited

U.S. PATENT DOCUMENTS 1,755,605 A 4/1930 Knox
2,581,099 A 1/1952 Guffey
2,783,925 A 3/1957 Ross
3,477,622 A 11/1969 Appelt
4,061,170 A 12/1977 Marks
4,349,102 A * 9/1982 Strongwater ..... 206/45.24
4,565,287 A 1/1986 Rede
4,742,914 A * 5/1988 Klein ..... 206/461
5,011,053 A 4/1991 Davies
5,177,881 A 1/1993 Moore
5,234,141 A 8/1993 Spiece
5,642,809 A 7/1997 Mayville
5,983,518 A 11/1999 Ellenburg
6,371,290 B1 4/2002 Yearous

* cited by examiner

*Primary Examiner*—Jacob K Ackun, Jr.
(74) *Attorney, Agent, or Firm*—George R. Reardon

(57) ABSTRACT

A glove shaper kit for drying, forming and merchandising a golf glove is disclosed. The kit includes a moisture absorbing glove form having four fingers substantially parallel with each other proceeding from a wrist area with a hole formed in the wrist area, where the hole has an animal shape associated with a professional sports figure, means for attachment inserted within the non-uniformly shaped hole, a glove and a container.

9 Claims, 6 Drawing Sheets

GLOVE SHAPER KIT

FIELD OF THE INVENTION

The present invention relates to the field of glove kits. In particular the present invention is drawn to a glove kit that may be used in drying a wet glove, helping to retain its shape, and in theme merchandising.

BACKGROUND OF THE INVENTION

Golfers often wear a single golf glove which may typically be made of leather and may also be fairly expensive. The glove may become damp or wet in use from perspiration, dew or precipitation and when not in use might typically be balled or rolled up and inserted in a pocket in a golf bag or the like. As a result, the glove does not dry properly, becomes wrinkled and deformed, and prematurely cracks and wears out.

Additionally, leather gloves, particularly those used in athletics such as golf or handball, are commonly short-lived due to the combined effects of desiccation and moisture, in addition to ordinary wear and tear. By desiccation is meant here the loss from the leather of essential oils and fats which normally operate to keep the leather flexible, soft and supple. In this regard, the frequent use of a glove in its ordinary application results in desiccation through the effects of sunlight, perspiration and abrasion. If allowed to persist, such desiccation usually leads to the drying and cracking of the leather.

Leather gloves also undergo deterioration by the effects of mold or mildew, which thrive particularly well in leather moistened with perspiration. This problem is particularly acute when the glove is used daily and stored in a damp enclosed space, such as in a locker, a golf bag or other athletic bag. When so stored there is often insufficient time for the glove to be thoroughly dried between uses. This problem is even more acute in humid climates, where even thorough airing may not dry the glove sufficiently to prevent the growth of mold or mildew.

Devices for shaping and drying gloves are well known in the art. Such devices typically take the general shape of a partial or complete hand. The prior art also discloses the use of different materials for making glove forms, including wood, wire and solid metals, molded plastics, and combinations thereof. Some devices are completely rigid, while others are formable or articulating.

This prior art also shows simple one piece constructions, as well as more complex adjustable and articulating constructions in which the form may be adjusted to accommodate varying glove sizes.

In addition to the drying and shape retention aspects there are also the aspects of merchandizing, e.g. packaging, presentation, theme marketing. It is well known in sports, especially in golf, for the top players to have a nickname. In some cases this nickname is associated with an animal, e.g. "Tiger", "The Golden Bear", "The Shark", "The Turtle", "Chicken Hawk", "The BullDog", "The Pink Panther", "The Angry Ant". While a direct endorsement by an athlete to promote a product is well known, e.g. television commercials, radio commercials, billboards, printed media, promoting a product by utilizing the associated animal nickname of a top athlete is a more indirect approach. Another marketing approach is to combine the use of rhyming words to a feature of the product, e.g., naming the product "glove dove" and having the product contain an image of a dove in some form or fashion. There is a long standing need within the marketing industry for fresh approaches to increase merchandising success.

Therefore, there is a real need for a simple and inexpensive glove form which may be used to condition a golf glove by retaining its shape and facilitating drying. There is also a need for a novel theme merchandising kit containing such a glove form.

Related art that addresses these and other problems includes the following patents.

U.S. Pat. No. 1,569,283, issued to Johnson on Jan. 12, 1926, discloses a means for shaping and drying fabric articles.

U.S. Pat. No. 1,755,605, issued to Knox on Apr. 22, 1930, discloses a drier for hand coverings which effectively dries gloves without shrinkage.

U.S. Pat. No. 2,581,099, issued to Guffey on Jan. 1, 1952, discloses a folding container for purses or handbags.

U.S. Pat. No. 2,783,925, issued to Ross on Mar. 5, 1957, discloses a glove drier having a movable thumb-supporting element hingedly connected with a palm-supporting portion of the drier.

U.S. Pat. No. 3,477,622, issued to Appelt on Nov. 11, 1969, discloses a glove drying device including a structure having a contour with simulates gloves so that it can support the gloves for drying. The structure is modular and interconnected so that when it is disassembled it is flat and can be stored.

U.S. Pat. No. 4,061,170, issued to Marks on Dec. 6, 1977, discloses a glove conditioning container designed particularly for conditioning gloves used for various sports such as golf and handball. The subject container comprises a foldable type member which includes means for separating gloves contained therein and further includes means for permitting a controlled amount of air to reach the gloves while stored therein.

U.S. Pat. No. 4,565,287, issued to Rede et al. on Jan. 21, 1986, discloses an apparatus for preservation of a leather glove. A hollow perforated hand-shaped form, sized to fit snugly within a glove, contains a dehydrating agent which draws moisture out of the glove. The form and glove are insertable in a protective case. The case includes a porous inner lining which is impregnated with a leather emollient. The combined action of the dehydrating agent and the emollient-impregnated lining is to remove moisture, thereby preventing the formation of mold or mildew, and at the same time infuse the emollient into the glove to maintain its suppleness and flexibility.

U.S. Pat. No. 5,011,053, issued to Davies on Apr. 30, 1991, discloses an apparatus including a main body member configured as a hand to receive a glove thereon to maintain the glove in a stretched and shaped configuration to prevent drying and shrinking of the glove. The main body includes a matrix of openings therethrough permitting air circulation throughout, as well as a loop formed on a lowermost end of the body to enhance directing of the body interiorly of an associated glove. The palm includes a recess to permit an individual to manually grasp a glove in directing the glove over the body. Modifications of the instant invention include the main body formed of a woven, porous mesh permitting air circulation therethrough, with the mesh formed with an interior fabric liner to receive and subsequently direct preservation oils into a glove mounted on the body. Furthermore, a central core sponge may be utilized to provide a reservoir of oil to be directed through the cloth liner and the mesh body into an associated glove. The mesh body is malleable to permit the fingers to be manipulated to enable stretching of a glove mounted on the body.

U.S. Pat. No. 5,177,881, issued to Moore on Jan. 12, 1993, discloses a golfing accessory capable of being attached to the exterior of a golf bag includes a plate-like portion providing space for the name of the golfer and the logo of a particular golf course or golfing event. The plate-like element is attached to a first strap attached to the bag. A second strap hangs from the plate-like portion and contains a fastener thereon for detachably securing a golf glove for the purpose of drying the glove. A hook may also be provided on the first strap for hanging a golfing towel.

U.S. Pat. No. 5,234,141, issued to Spiece on Aug. 10, 1993, discloses a conditioner for a golf glove is made from a piece of solid aromatic cedar cut generally to the shape of a hand and having a palm portion and at least three fingers extending therefrom. A manually operable spring clip is attached to the palm portion to receive the open edge of the glove which is slipped onto the fingers and over the palm portion to hold the glove in position and help retain its shape. A simple bead chain or other attachment device may be mounted on an extended portion of the conditioner to allow the device to be hung on a golf bag or the like.

U.S. Pat. No. 5,642,809, issued to Mayville on Jul. 1, 1997, discloses a foldable case for golf gloves and other accessories wherein a pair of gloves, possibly in a damp condition, are interleaved between absorbent surfaces, without exposure to the open air, so as to be dried without risk of over-drying and the stiffening. The absorbent element placed between the gloves may comprise two layers of absorbent material, joined together along the edges to provide a storage pouch for small items U.S. Pat. No. 5,983,518, issued to Ellenburg on Nov. 16, 1999, discloses a golf glove drying attachment for a golf cart or a golf bag, intended to improve air circulation through the glove while the user is on the golf course. The glove drying attachment includes a slightly tapered shell for holding the glove, and a clamp for attaching to a golf cart. As the golf cart is driven, wind from the golf cart dries the glove. Alternatively, the shell may include a battery powered fan, and attach to a golf bag.

U.S. Pat. No. 6,371,290, issued to Yearous et al. on Apr. 16, 2002, discloses a reusable package for an athletic glove includes a body made of non-flaccid translucent plastic. The body has two halves joined together along a living hinge, such that the body can be moved between an open configuration, wherein the interior of the package is exposed, and a closed configuration, wherein a glove can be enclosed by the package. To facilitate drying the glove after it is used and then replaced back into the package in a substantially unfolded, relaxed configuration one of the body halves is formed with vent holes. The other body half is formed with a relatively thinner area that functions as a window, with the remainder of the body half being thicker than the window.

While these patents and other previous methods have attempted to solve the problems that they addressed, none have utilized or disclosed a glove shaper kit having both merchandizing, drying and forming elements, as does embodiments of the present invention.

Therefore, a need exists for a glove shaper kit with these attributes and functionalities. The glove shaper kit according to embodiments of the invention substantially departs from the conventional concepts and designs of the prior art. It can be appreciated that there exists a continuing need for a new and improved glove shaper kit which can be used commercially. In this regard, the present invention substantially fulfills these objectives.

The foregoing patent and other information reflect the state of the art of which the inventor is aware and are tendered with a view toward discharging the inventor's acknowledged duty of candor in disclosing information that may be pertinent to the patentability of the present invention. It is respectfully stipulated, however, that the foregoing patent and other information do not teach or render obvious, singly or when considered in combination, the inventor's claimed invention.

BRIEF SUMMARY OF THE INVENTION

The general purpose of the present invention, which will be described subsequently in greater detail, is to provide a glove shaper kit. In particular, the present invention relates to an assembly that provides a packaged glove drying and shaping form with theme marketing elements.

Generally speaking, an exemplary embodiment of the present invention is comprised of a glove form, a glove and a container. The glove form is in the general shape of a human hand, with four fingers positioned substantially parallel to each other, but with no thumb, and provides support for the drying and forming of a glove. The thickness of the glove form is substantially thinner than a human hand.

The glove form has a hole at the wrist portion of the glove form. The hole may be used to hang the glove form on a support, e.g. a peg, or to insert means for attaching the glove form to another object, e.g. a golf bag. The means for attaching may be a strip of hook-and-loop fastener, a bead chain, a strip of leather, a string, a length of yarn, a strip of material with a snap fastener, wire, and the like, or combinations of these.

The hole may be uniformly shaped, e.g. circular, oblong, or irregularly shaped, e.g. a geometric shape, a shape generally resembling an animal or a recognizable shape of a person, place or thing. The shape of the hole may relate to the nickname of a sports player, e.g. a top golfer. The shape of the hole may correspond to a logo or trademark used in merchandizing one or more elements of the glove shaper kit.

The glove form is sized to fit into the glove element of the glove shaper kit. The glove form may be formed of wood, e.g. aromatic cedar. The glove form may be made of a moisture absorbing material, e.g. a amorphous silicate material formed by the steps of: parboiling rice under 22 psi and at a temperature above 212 degrees F. to force bran into the rice grain and dissolve cellulose from the rice hulls creating voids in the rice hulls; drying the parboiled rice; milling the parboiled rice into grain, bran, and broken rice hulls; separating the broken rice hulls from the grain and bran; and burning the broken rice hulls at high temperatures to produce a skeletal residue of amorphous silicate material.

The glove form may be formed of combinations of wood and moisture absorbing materials, e.g. a central core of wood with laminates of moisture absorbing materials affixed thereto, a central core of wood with a layer of moisture absorbing materials sprayed thereon.

The glove may be a golf glove, a handball glove or the like. The container may be a display package for initial merchandizing, or may be a storage package during the drying and forming process, or both.

One aspect of the present invention is that it provides for the drying of a glove.

Another aspect of the present invention is that it provides for the forming of a glove.

Another aspect of the present invention is that it provides for theme marketing.

Another aspect of the present invention is that it may be made from readily available components.

Another aspect of the present invention is that it may be economically manufactured.

Another aspect of the present invention is that it may be made utilizing existing manufacturing techniques.

These and other features and advantages of the present invention will be presented in more detail in the following specification of the invention and the accompanying figures, which illustrate by way of example the principles of the invention.

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE SEVERAL VIEWS OF THE DRAWINGS

The invention, together with further advantages thereof, may best be understood by reference to the following description taken in conjunction with the accompanying drawings in which.

DETAILED DESCRIPTION OF THE INVENTION

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known operations have not been described in detail so not to unnecessarily obscure the present invention.

Figure 1:
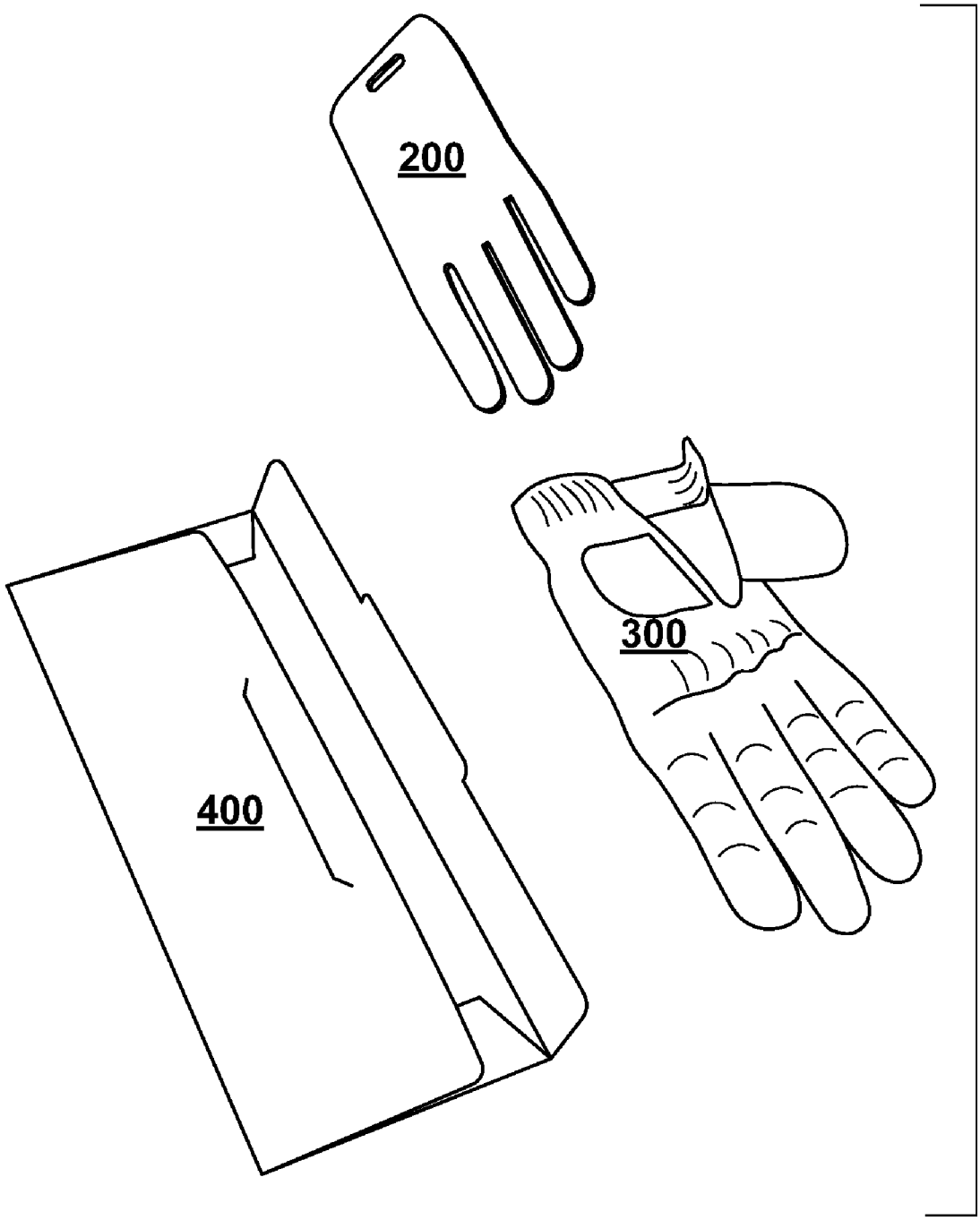
FIG. 1 illustrates an exploded view of a glove shaper kit, according to an embodiment of the present invention.
Figure 2:
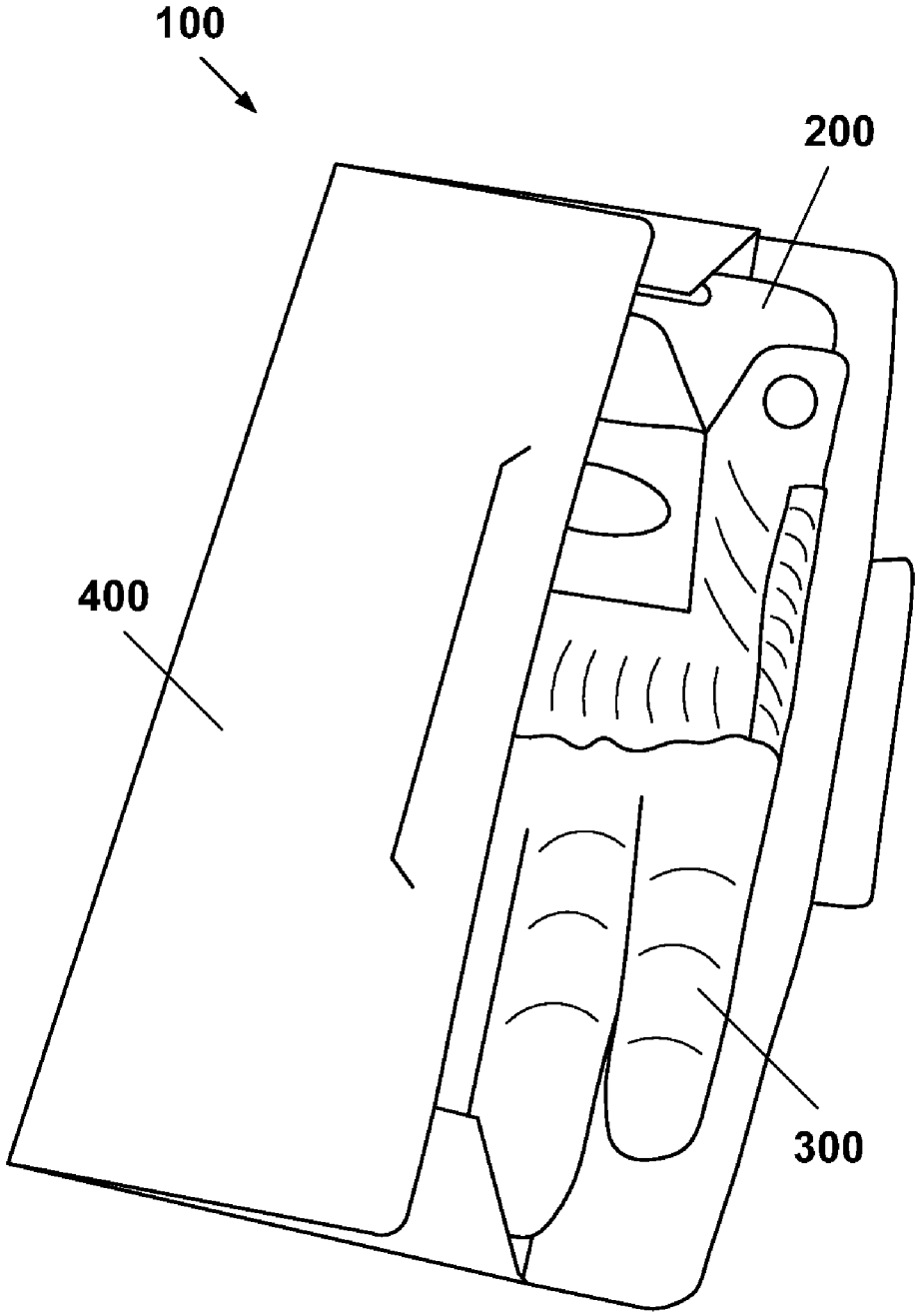
FIG. 2 illustrates a perspective view of a glove shaper kit, according to an embodiment of the present invention.
Figure 3:
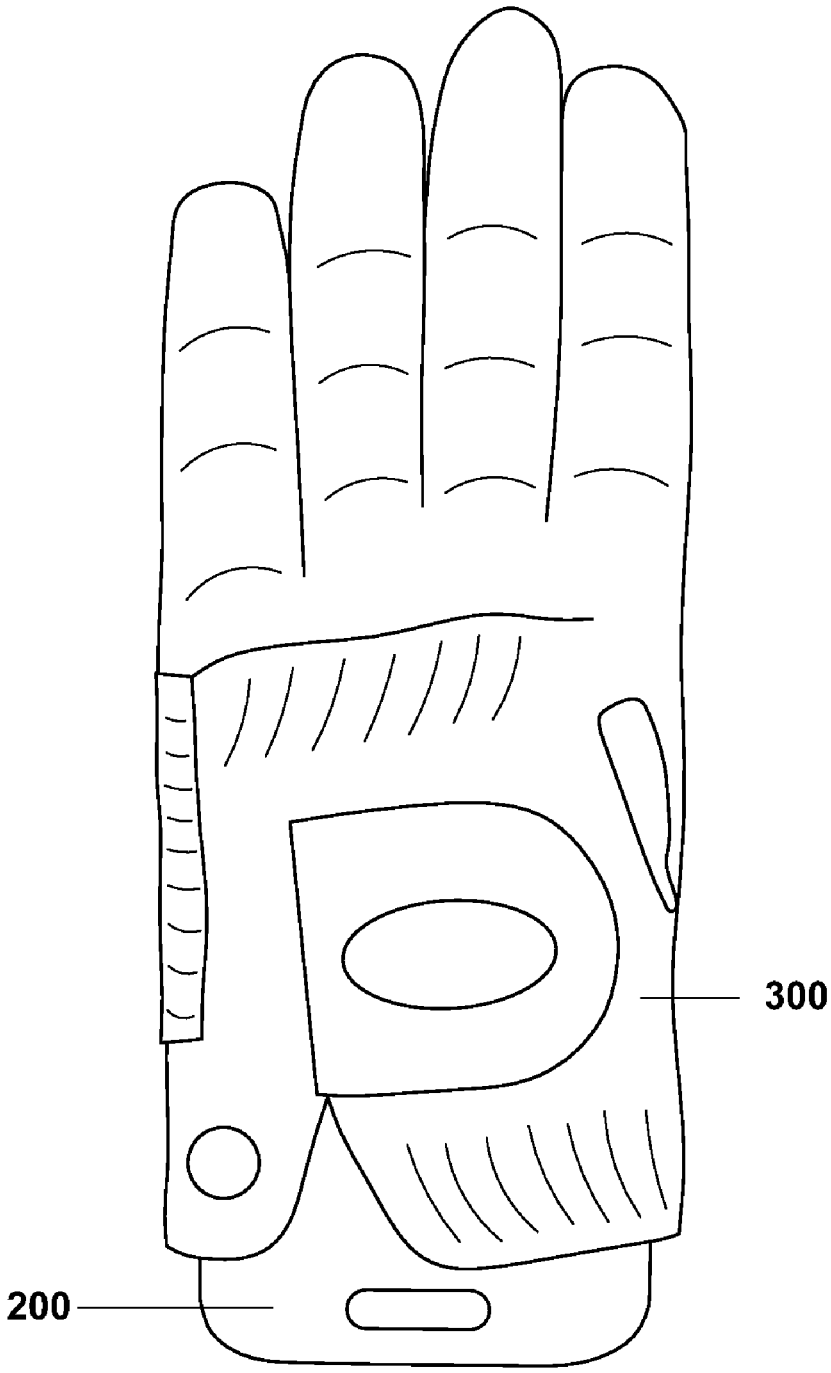
FIG. 3 illustrates a rear plan view of two elements of a glove shaper kit, according to an embodiment of the present invention.
Figure 4:
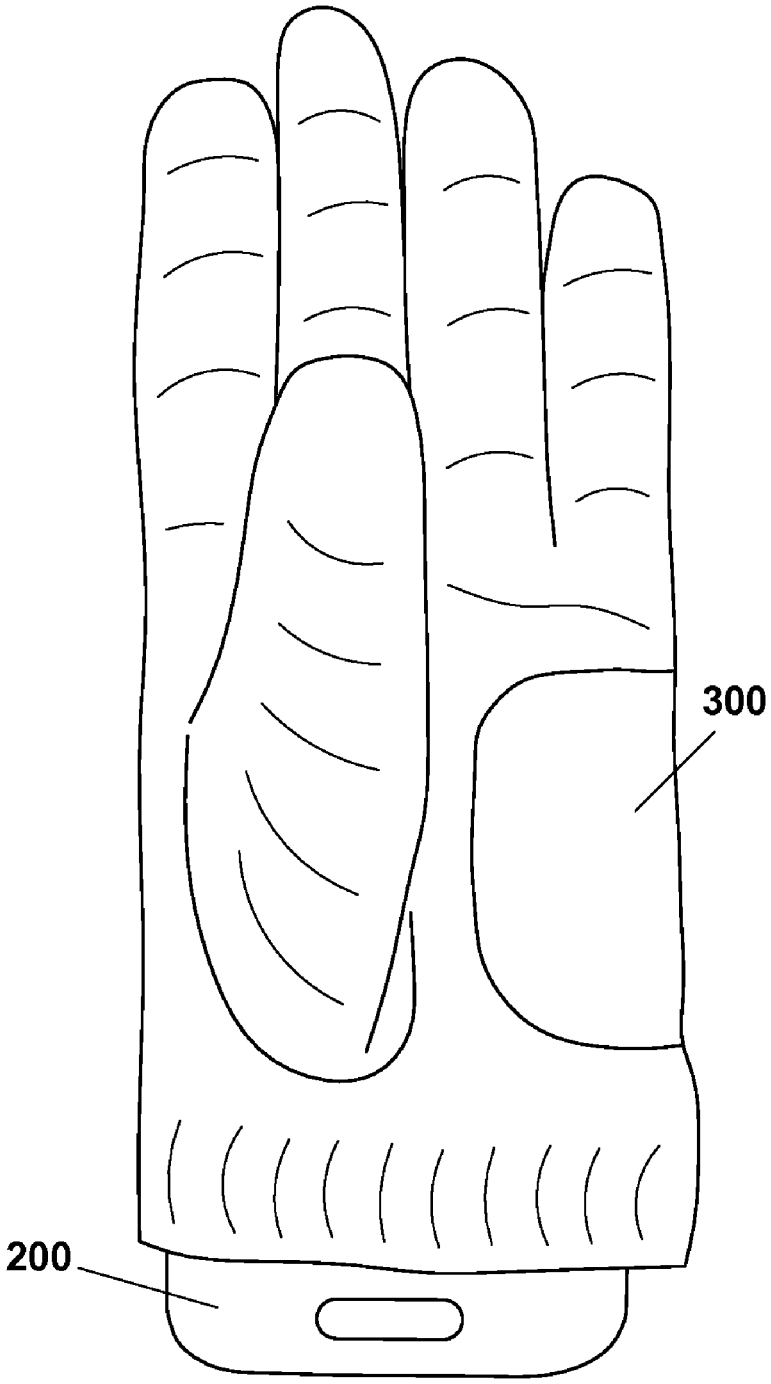
FIG. 4 illustrates a front plan view of two elements of a glove shaper kit according to an embodiment of the present invention.
Figure 5:
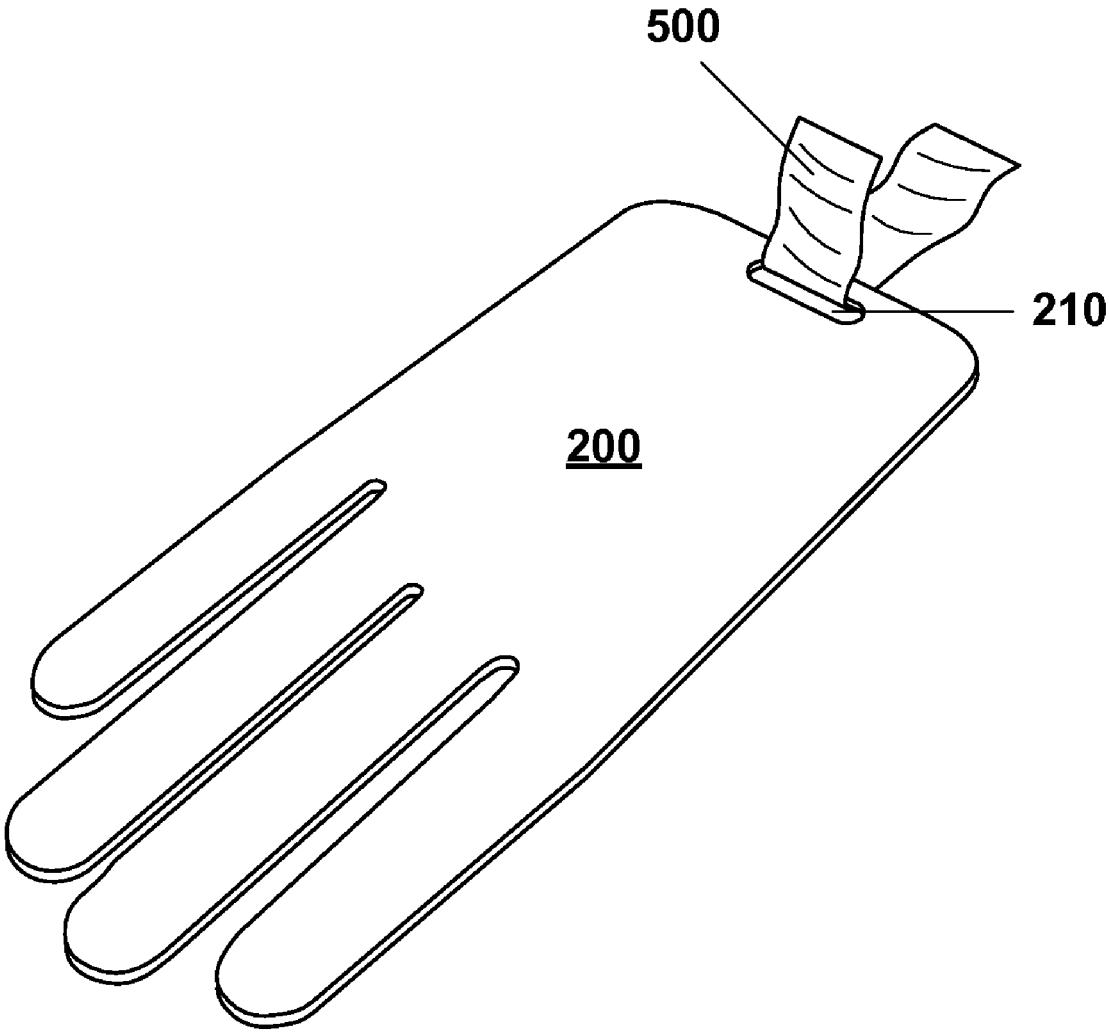
FIG. 5 illustrates a perspective view of a glove form and means for attaching, according to an embodiment of the present invention.
Figure 6:
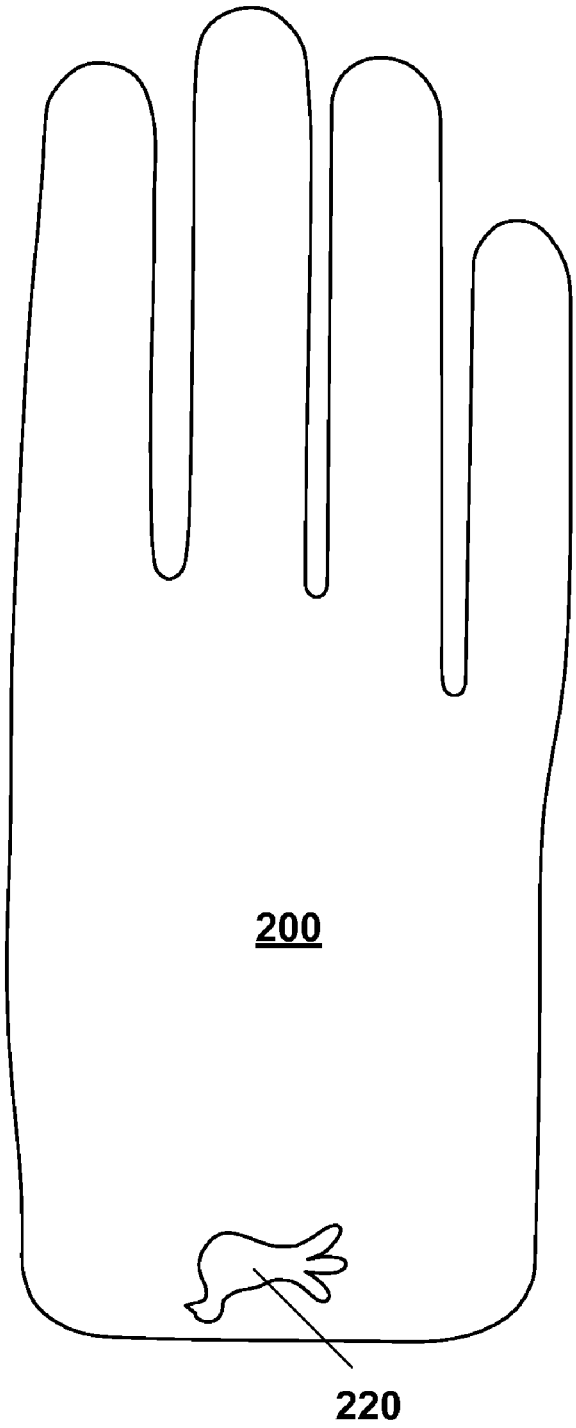
FIG. 6 illustrates a rear plan view of a glove form showing a dove-shaped hole to facilitate theme marketing, according to an embodiment of the present invention.

Referring now to FIG. 1 through FIG. 6, a glove shaper kit 100 is comprised of a thin glove form 200 having four fingers substantially parallel with each other proceeding from a wrist area with a hole formed in the wrist area. In some embodiments the hole is a uniformly shaped hole 210, e.g., circular, oblong. In other embodiments the hole is a non-uniformly shaped hole 220. The non-uniformly shaped hole 220 may be shaped to resemble an animal associated with the nickname of a professional athlete, e.g., a professional golf player. The glove shaper kit may be further comprised of attachment means 500.

The glove shaper kit may be further comprised of a glove 300, into which glove form 200 is inserted, along with attachment means 500. The glove shaper kit may be further comprised of a container 400, into which the glove 300 with the inserted glove form 200 is placed, along with attachment means 500.

In some embodiments the glove shaper kit may be comprised of glove form 200, and container 400. In other embodiments the glove shaper kit may be comprised of glove form 200, attachment means 500 and container 400.

In one embodiment the glove shaper kit for drying, forming and merchandising a golf glove comprises a moisture absorbing glove form having four fingers substantially parallel with each other proceeding from a wrist area with a non-uniformly shaped hole formed in the wrist area, where the non-uniformly shaped hole has an animal shape; and means for attachment inserted within the non-uniformly shaped hole. The animal shape is selected from the group comprising vertebrates and invertebrates. The means for attaching is comprised of one or more of a strip of hook-and-loop fastener, a bead chain, a strip of leather, a string, a length of yarn, a strip of material with a snap fastener, wire. The vertebrates are comprised of echinoderms, annelids, mollusks, arthropods, crustaceans, arachnids, and insects. The invertebrates are comprised of mammals, fish, amphibians, reptiles, birds, marsupials, primates, rodents and cetaceans. The glove shaper kit is further comprised of a glove and a container. The glove form is inserted into the glove and the glove form and glove are inserted into the container. The animal shape is selected from tiger, bear, shark, turtle, chicken hawk, bulldog, panther, ant.

In another embodiment, the glove shaper kit for drying, forming and merchandising a golf glove comprises a moisture absorbing glove form having four fingers substantially parallel with each other proceeding from a wrist area with a uniformly shaped hole formed in the wrist area; means for attachment inserted within the uniformly shaped hole; a glove; and a container, where the glove form is inserted into the glove and the glove form and glove are inserted into the container. In this embodiment the kit the means for attaching is comprised of one or more of a strip of hook-and-loop fastener, a bead chain, a strip of leather, a string, a length of yarn, a strip of material with a snap fastener, wire.

From the foregoing, it will be appreciated that, although specific embodiments of the invention have been described herein for purposes of illustration, various modifications may be made without deviating from the spirit and scope of the invention. For example, many of the features and components described above in the context of a particular glove shaper kit configuration can be incorporated into other configurations in accordance with other embodiments of the invention. Accordingly, the invention is not limited except by the appended claims.

What is claimed is:

1. A kit for drying, forming and merchandising a golf glove comprising:

a moisture absorbing glove form constructed with at least a portion of the form being an amorphous silica moisture absorbing material and having four fingers substantially parallel with each other proceeding from a wrist area with a non-uniformly shaped hole formed in the wrist area, wherein the non-uniformly shaped hole is formed by a closed-loop path that defines a silhouette of an animal thereby to represent an animal shape; and means for attachment inserted within the non-uniformly shaped hole.

2. The kit according to claim 1, wherein the animal shape is selected from the group comprising vertebrates and invertebrates, wherein the means for attaching is comprised of one or more of a strip of hook-and-loop fastener, a bead chain, a strip of leather, a string, a length of yarn, a strip of material with a snap fastener, wire.

3. The kit according to claim 2, wherein the vertebrates are comprised of echinoderms, annelids, mollusks, arthropods, crustaceans, arachnids, and insects, wherein the invertebrates are comprised of mammals, fish, amphibians, reptiles, birds, marsupials, primates, rodents and cetaceans.

4. The kit according to claim 3, further comprising a glove.

5. The kit according to claim 4, further comprising a container.

6. The kit according to claim 5, wherein the glove form is inserted into the glove and the glove form and the glove are inserted into the container.

7. The kit according to claims 6, wherein the animal shape is selected from tiger, bear, shark, turtle, chicken hawk, bulldog, panther, ant.

8. A kit for drying, forming and merchandising a golf glove comprising:

a moisture absorbing glove form constructed with at least a portion of the form being an amorphous silica moisture absorbing material and having four fingers substantially parallel with each other proceeding from a wrist area with a uniformly shaped hole formed in the wrist area;

means for attachment inserted within the uniformly shaped hole;

a glove; and a container, wherein the glove form is inserted into the glove and the glove form and the glove are inserted into the container.

9. The kit according to claim 8, wherein the means for attaching is comprised of one or more of a strip of hook-and-loop fastener, a bead chain, a strip of leather, a string, a length of yarn, a strip of material with a snap fastener, wire.

* * * * *